United States Patent [19]

Schaubeck

[11] Patent Number: 4,527,701

[45] Date of Patent: Jul. 9, 1985

[54] TAMPER INDICATING CHILD RESISTANT CLOSURE

[75] Inventor: Paul E. Schaubeck, San Jose, Calif.

[73] Assignee: Owens-Illinois, Inc., Toledo, Ohio

[21] Appl. No.: 645,206

[22] Filed: Aug. 29, 1984

[51] Int. Cl.[3] ..... B65D 55/02

[52] U.S. Cl. ..... 215/220; 215/251

[58] Field of Search ..... 215/220, 219, 250, 251, 215/253

[56] References Cited

U.S. PATENT DOCUMENTS

| | | | |
|---|---|---|---|
| 4,371,088 | 2/1983 | Gach | 215/220 |
| 4,446,979 | 5/1984 | Gach et al. | 215/220 |
| 4,474,301 | 10/1984 | Davis | 215/220 |

*Primary Examiner*—George T. Hall

*Attorney, Agent, or Firm*—John R. Nelson

[57] ABSTRACT

A two-piece child resistant closure is disclosed in which an outer, molded plastic, closure driving member is formed with an indicator portion that is connected thereto with some webs that are frangible and some non-frangible. The inner plastic member is formed with internal threads that engage the container and it has lugs which engage driving lugs of the outer member when the outer member is pushed down a predetermined amount. The inner member has an upstanding plunger that serves to engage the indicator and break the frangible connections upon displacement of the members to place them in driving connection for removal of the inner member from the container.

7 Claims, 6 Drawing Figures

TAMPER INDICATING CHILD RESISTANT CLOSURE

BACKGROUND OF THE INVENTION

Child resistant closures of the two-piece type, such as disclosed in U.S. Pat. No. 3,857,505, are of the "Press and Twist" type where an outer cap with engaging drive lugs is held away from complimentary drive lugs on an inner cap by spring members between the two caps. The spring members carried by the outer cap may engage ramp style lugs and effect rotation of the caps in the cap applying direction to apply the cap to a threaded container neck or finish. When the outer cap is rotated in the opposite direction, the springs ride up the ramps and do not rotate the inner, threaded cap from the container.

When the outer cap is "pushed" or pressed down relative to the inner cap, the spring members will permit the complimentary drive lugs to be interengaged and rotation of the outer cap will be transmitted to the inner cap to permit removal of the inner cap from the container.

While the foregoing patented closure is a successful and widely used commercial closure for products that may be harmful to children, it has recently become a concern that the opening of these containers can be effected without leaving any evidence of the fact of its opening.

The ability to apprise the consumer of the previous tampering of the closure and container, so that he may be aware that possible tampering with the contents had occurred, is a significant and important consideration in the marketing of some over-the-counter products.

A recently issued U.S. Pat. No. 4,371,088 discloses a tamper indicating closure wherein an inner cap 12 is covered by an outer cap or "driver top" 14. The driver top may be depressed to bring lugs 40 into engagement with ribs 28 of the cap 12. When the displacement is made, head 62 of an indicator having a stem 64, is separated from the outer cap. When the indicator element is displaced, webs are fractured, and the element may fall away from the outer cap.

SUMMARY OF THE INVENTION

A tamper indicating child resistant closure for threaded containers wherein relatively rotatable inner and outer caps are assembled together with the outer cap acting as the driver for an inner cap that is threaded on the container. The outer cap is normally in driving engagement with the inner cap only in the cap applying or "closing" direction and it is necessary to press down on the outer cap and displace the outer cap against spring members to cause drive lugs on the outer cap to engage complimentary lugs on the inner cap to effect rotation of the two caps in the "opening" direction. An indicator is carried by the outer cap and it is actuated when the caps are so displaced that the driving lugs and complimentary lugs have been put into driving engagement. The indicator is of a type that provides a visual indication and it cannot be resorted to its previous condition after it has once been actuated. The indicator also remains with the closure.

It is an object of the present invention to provide a tamper indicating child resistant closure of the "press-twist" type.

It is a further object of this invention to provide a tamper indicating closure wherein a frangible member is broken once the closure has been opened or placed in condition to effect opening thereof.

It is a still further object of this invention to provide a two-piece, tamper indicating closure having an indicator element which is connected to the closure by frangible means such that upon displacement of an outer cap toward an inner cap, to the extent necessary to drivingly engage the caps, that an indicator element will be broken away from its connection to the outer cap with the exception of at least one non-frangible web connection.

DETAILED DESCRIPTION OF THE DRAWINGS

Figure 1:
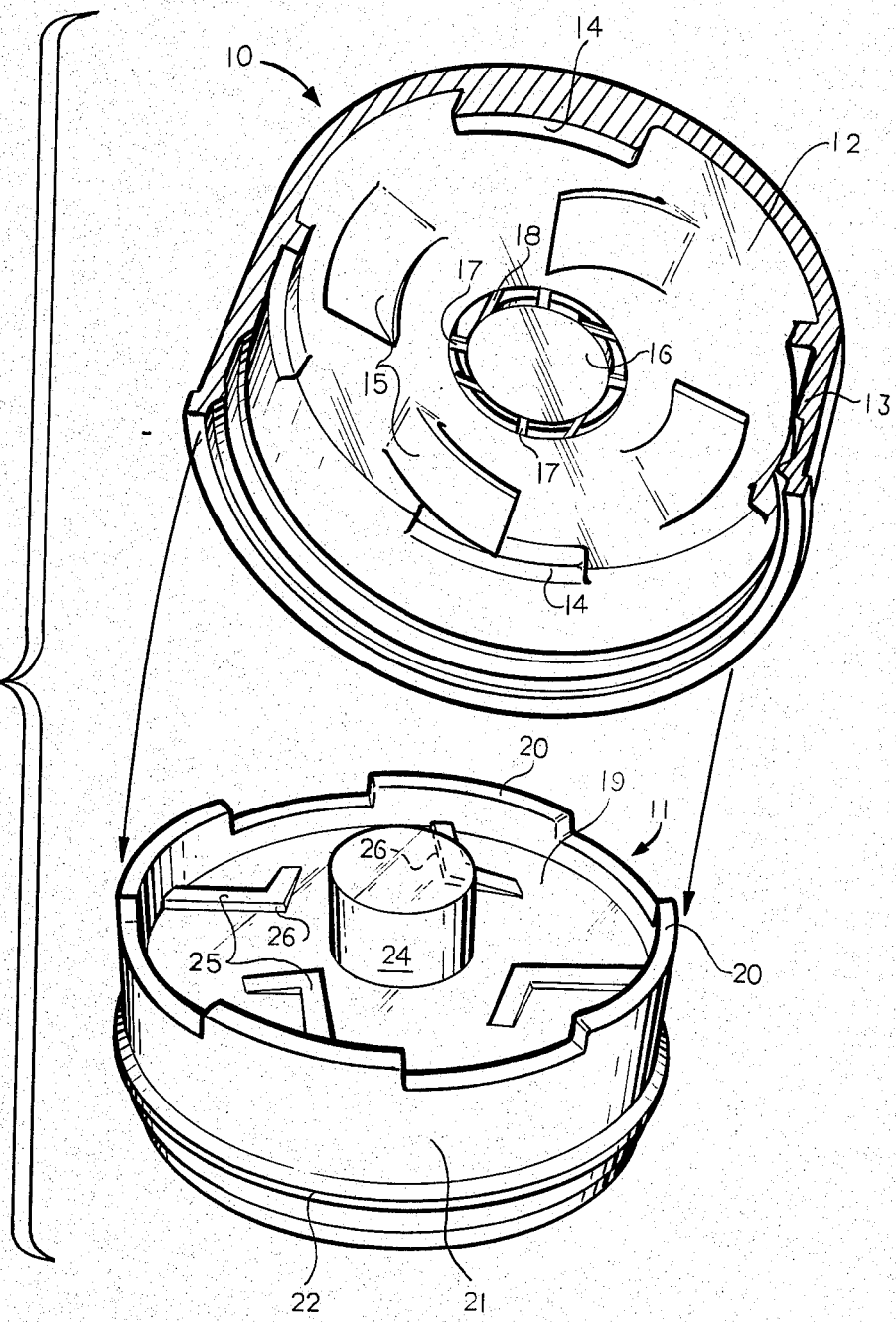
FIG. 1 is an exploded perspective view of a two-piece closure embodying the invention.

With particular reference to FIG. 1, there is shown a closure generally composed of two elements, an outer cap 10 and an inner cap 11. The outer cap 10 has a generally flat top 12 and depending cylindrical skirt 13. At the juncture of the skirt 13 and the inside of the flat top 12 there are provided four driving lugs 14. The driving lugs 14 are generally elongated, rectangular elements following the contour of the inner skirt. Extending downward from the flat top 12 interiorly of the outer cap 10 are four leaf spring members 15. These spring members 15 are connected at one end to the inside of the top 12 and extend downwardly at an angle of approximately 30° to the horizontal. Adjacent the center of the outer cap 10, and as shown in FIG. 1, coplanar with respect to the flat top 12 thereof, is a circular indicator element 16. The element 16 is joined to the flat top 12 by a plurality of webs 17 and 18. The webs 17 extend radially outwardly from the cylindrical indicator element 16, while the webs 18 are tangential to the circumference of the indicator element and join also to the inner opening formed in the flat top 12. This relationship of the webs to the indicator element is better illustrated in FIGS. 3 and 4 where it is shown that there are four radial webs and four tangential webs 18 connecting the indicator element 16 to the flat top 12 of the outer cap 10. The inner cap 11 is formed with a generally horizontal flat top 19. Extending above the top surface of the member 19, at the periphery thereof, are four complimentary lugs 20. Between the lugs 20 are gaps within which the driving lugs 14 of the outer cap 10 are adapted to be engaged. The complimentary lugs 20 are generally vertical extensions of an annular skirt portion 21 of the inner cap 11. The lower end of the skirt portion 21 of the inner cap 11 is formed with an outstanding bead 22 which is adapted to be positioned within an annular recess 23 formed in the lower skirt portion 13 of the outer cap 10. While in the assembled form as illustrated best in FIG. 2, the inner and outer caps will be held in the assembled position by the bead 22 riding within the annular recess 23 and the spring members 15 will be biasing the inner cap 11 axially downward with respect to the outer cap 10.

Figure 2:
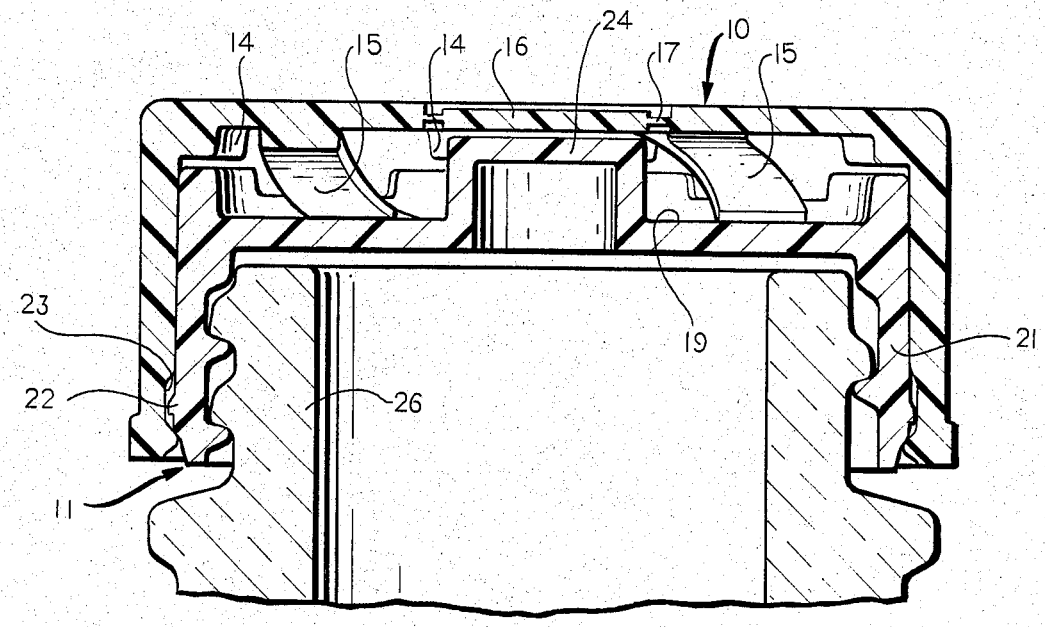
FIG. 2 is a vertical, sectional view of the two-piece closure of FIG. 1 in assembled condition and applied to a threaded container.
Figure 3:
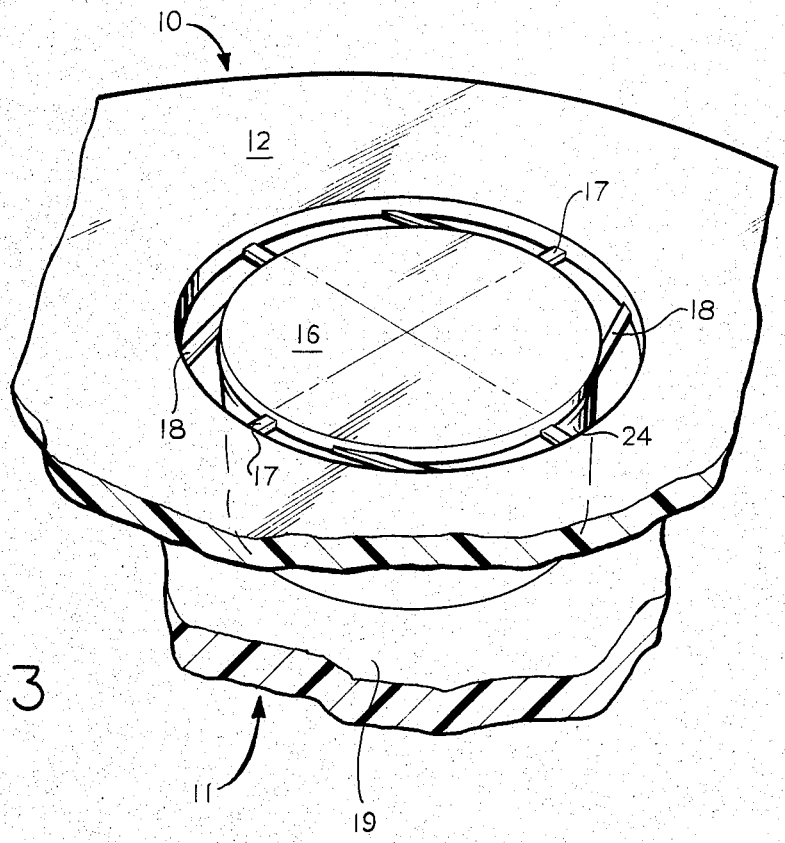
FIG. 3 is an enlarged, perspective view of the indicator portion of the closure of FIG. 2.

Centrally of the inner cap is a cylindrical, vertical projection 24. As can best be seen in FIG. 2, the projection 24 is positioned coaxially with and slightly below the indicator element 16 of the outer cap 10. Referring again to FIG. 1, the planar surface 19 of the lower or inner cap 11 is provided with four ramp lugs 25. These ramp lugs 25 cooperate with the free ends of the spring members 15 such that upon clockwise rotation of the outer cap 10 relative to the inner cap 11 the free ends of the springs will engage vertical surfaces 26 of the lugs 25 and thread the inner cap onto a container finish 26 as illustrated in FIG. 2. It should be understood that the inside of skirt 21 of the inner cap 11 is provided with threads which match the threads that are provided on the external annular surface of the finish 26 of the container on which the closure is applied. Rotation of the outer cap 10 in a counterclockwise direction as viewed in FIGS. 1 and 2 results in the spring members 15 riding up the ramp surfaces of the ramp lugs 25 and resulting in no disturbance of the inner cap 11 relative to the container finish 26.

Figure 4:
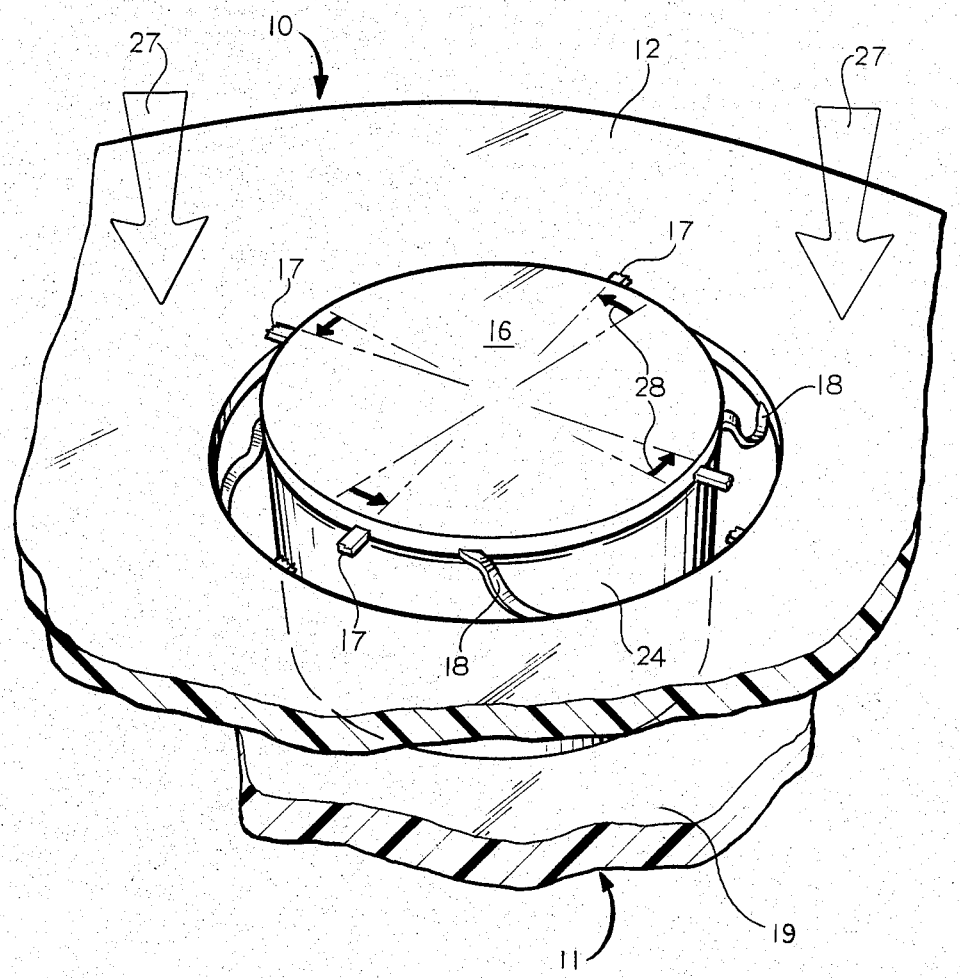
FIG. 4 is a view similar to that of FIG. 3, after the outer cap has been displaced relative to the inner cap.

In order for the inner cap 11 to be removed from the container finish 26, it is necessary that the outer cap 10 be pressed downwardly to engage the lugs 14 in the spaces between the lugs 20 of the inner cap 11. When this force is applied, the projection or plunger 24 of the inner cap 11 will be forced against the indicator 16 and downward displacement of the outer cap 10 results in the indicator element 16 being broken from the top 12 of the outer cap 10. As can be seen when viewing FIG. 4, movement of the outer cap 10 in the direction of the large arrows 27 is the direction necessary to engage the driving lugs of the outer and inner caps and results in the radial webs 17 being severed, but the tangential webs 18, since they are considerably longer than the radial webs 17, will remain connected to the indicator 16. It should be pointed out, however, that this vertical displacement causes the indicator 16 to rotate to a certain degree as illustrated by the small arrows 28 on the top of the indicator member 16. Once the outer cap 10 has been displaced or pressed down as illustrated in FIG. 4, it readily is apparent that the closure has been tampered with and that the closure has been placed in the position of removal whether or not the actual removal has taken place. Thus, the press-down and twist portion of the closure, which renders the closure generally child-resistant, also becomes a tamper indicating closure system, since it is indicated by the fracture of the radial web 17 that the outer and inner caps have been relatively displaced.

Figure 5:
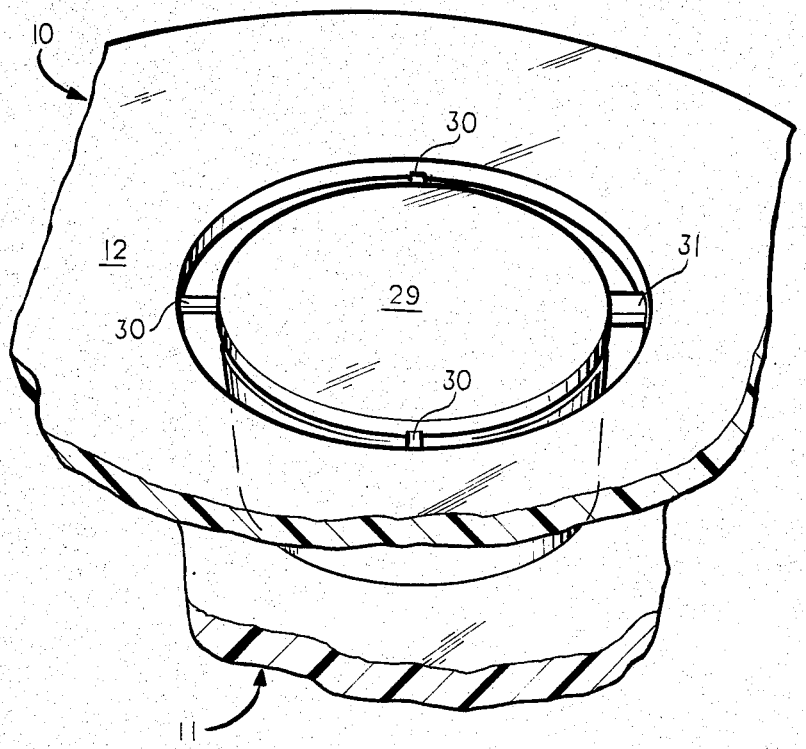
FIG. 5 is a perspective view, similar to that of FIG. 3, illustrating an alternative embodiment of an indicator element of the invention; and, FIG. 6 is a perspective view of the closure of FIG. 5 after being actuated for removal.
Figure 6:
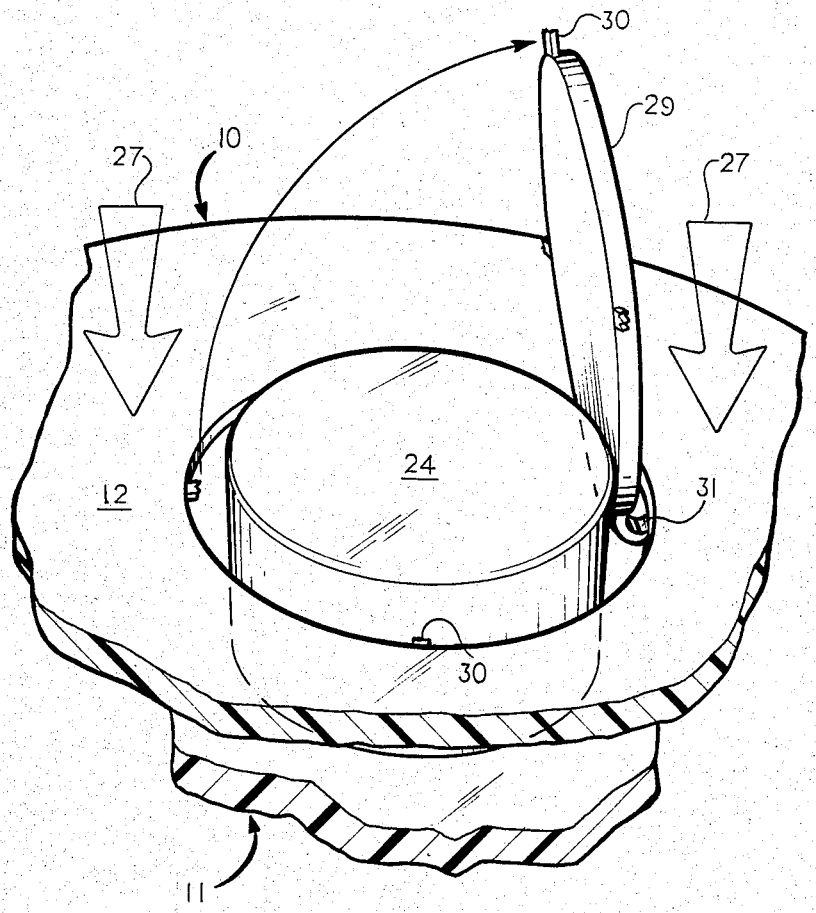

Turning now to FIGS. 5 and 6, there is shown an alternate embodiment in which an indicator element 29 of essentially similar configuration to that of the indicator element 16 is joined to the flat top 12 of the outer cap 10 by three frangible webs 30 and one non-frangible web 31. As in the previously described embodiment, the axial displacement of the outer cap 10 downwardly will result in the projection 24, which is formed integral with the inner cap 11 engaging the underside of the indicator element 29, fracturing the frangible webs 30 and causing the indicator element 29 to hinge about the non-frangible web 31. Again, the displacement of the outer cap relative to the inner cap is illustrated by the large arrows 27. It can thus be seen that in both instances, and in both embodiments, the indicator element 16 does not become completely separated from the outer cap. This is significant from the point of view that when the tamperproof operation of the invention is actuated, the indicator element does not become a discarded member and thus does not become a litter proliferating element. Thus, it can be seen that the closure of the invention provides both a child resistant and tamper indicating two-piece closure where an indicator element is displaced relative to the outer cap to clearly show that the closure may have been previously opened, and furthermore, that the tamperproof feature does not result in adding to the litter which might result if the indicator element were totally separated from the outer cap.

The particular child resistant closure without the tamper indicating feature is of the general type disclosed in U.S. Pat. No. 3,857,505 and assigned to the assignee of the present invention. Reference may be had thereto for a more complete description of the function of the elements of the two closures. However, it is believed that the foregoing description is sufficient to provide one skilled in the art with sufficient information that a full understanding of the present invention is provided.

I claim:

1. A tamper indicating child resistant closure for containers comprising: relatively rotatable inner and outer caps, said inner cap being internally threaded for engagement with threads on a container, a first set of engaging surfaces on said caps engageable with each other to turn said inner cap in a closing direction upon rotation of said outer cap in one direction, a second set of engaging surfaces on said caps operable to turn said inner cap in an opening direction upon simultaneous engagement of said surfaces and rotation of said outer cap in an opposite direction, said second set of engaging surfaces being engageable with each other only upon axial deflection of a part of said outer cap relative to said inner cap, an indicator element carried by said outer cap and connected thereto by frangible, severable members (webs), said inner cap including a projecting element disposed in alignment with and proximate the indicator element in said outer cap when said outer cap is not deflected and being engageable therewith to sever said frangible members upon axial deflection of said part of said outer cap to break said frangible webs.

2. The closure of claim 1 further including at least one non-frangible connecting member between said indicator and said outer cap to retain the indicator after the frangible members are broken.

3. The closure of claim 2 (or 1) wherein the indicator element is a circular member and said frangible members are radially extending webs connected between said circular member and an opening in said outer cap.

4. The closure of claim 3 wherein said non-frangible members are thin webs that extend between tangentially to the circumference of said circular member and said outer cap, whereby upon displacement of said indicator relative to said projecting element causes said indicator to be elevated and rotate relative to said outer cap.

5. The closure of claim 3 wherein said non-frangible member is a single, radially extending web between said indicator disc and said outer cap whereby displacement of said outer cap will cause the indicator member to swing up and out with the non-frangible member acting as a hinge.

6. A tamper indicating closure for a container comprised of outer and inner coacting elements arranged coaxially, the outer and inner elements being normally engaged only for application of the closure onto a container but requiring some coaxial relative movement of the two to engage them for removal from the container, the outer element of said closure having an indicator portion connected thereto by a frangible, severable connection means, and the inner element of said closure including a projection surface disposed adjacent said indicator portion of the outer element and engageable therewith to cause at least part of its said connection means to sever upon coaxial relative movement of said inner and outer elements an amount for initiating removal of the closure from the container, whereby said indicator portion of the outer element upon said severance of said frangible connection means provides a visual indication the container has been opened.

7. The closure of claim 6 further including at least one non-frangible connecting means between said indicator portion and said outer element to retain the indicator portion after the frangible connecting means have been broken.

* * * * *